US011071364B1

(12) United States Patent
Fowler

(10) Patent No.: US 11,071,364 B1
(45) Date of Patent: Jul. 27, 2021

(54) ARMBAND HOLDER FOR A PERSONAL ELECTRONIC DEVICE

(71) Applicant: Scott A. Fowler, Pendleton, OR (US)

(72) Inventor: Scott A. Fowler, Pendleton, OR (US)

( * ) Notice: Subject to any disclaimer, the term of this patent is extended or adjusted under 35 U.S.C. 154(b) by 0 days.

(21) Appl. No.: 16/900,153

(22) Filed: Jun. 12, 2020

(51) Int. Cl.

| | |
|---|---|
| ***A45F 5/00*** | (2006.01) |
| ***F41H 9/10*** | (2006.01) |
| ***A45C 13/30*** | (2006.01) |
| ***A45C 11/00*** | (2006.01) |

(52) U.S. Cl.
CPC ..... *A45C 13/30* (2013.01); *A45C 11/00* (2013.01); *A45F 5/00* (2013.01); *A45C 2011/002* (2013.01); *A45F 2005/008* (2013.01); *A45F 2200/0516* (2013.01); *A45F 2200/0591* (2013.01); *F41H 9/10* (2013.01)

(58) Field of Classification Search
CPC ..... A45F 2005/008; A45F 2200/0508; A45F 2200/0516; A45F 2200/0591; A45C 13/30; A45C 2011/001; A45C 2011/002; F41H 9/10
USPC ..... D3/218; 224/250, 930
See application file for complete search history.

(56) References Cited

U.S. PATENT DOCUMENTS 4,399,934 A * 8/1983 Dupont ..... A45F 5/02 224/240
4,463,879 A * 8/1984 Des Voignes ..... F41H 9/10 222/175
D316,999 S * 5/1991 Sarff ..... 224/250
5,121,865 A * 6/1992 Howard ..... A45F 5/00 224/240
5,374,919 A * 12/1994 Zelka ..... G08B 15/004 224/196
5,392,975 A * 2/1995 Blankenship, Jr. ..... B05B 9/08 206/317
D360,524 S * 7/1995 Snyder ..... D3/224
5,443,192 A * 8/1995 Hodges ..... A45F 5/021 224/148.6
5,477,999 A * 12/1995 Blankenship, Jr. ..... B05B 9/08 206/317
5,503,316 A * 4/1996 Stewart ..... B60R 7/05 224/312
5,607,090 A * 3/1997 Brown ..... A45C 1/04 222/175
5,941,434 A * 8/1999 Green ..... A47G 23/0225 224/250
6,056,174 A * 5/2000 Minckler ..... A45F 5/02 150/154
D455,255 S * 4/2002 Zeigler ..... D3/218
D548,959 S * 8/2007 McClain ..... D3/218
(Continued)

OTHER PUBLICATIONS

Ruger RURS01 Ultra Run Safe Pepper Spray System 125db Alarm. Product Listing [online]. © Copyright © 1995-2020 eBay Inc. [retrieved on Oct. 10, 2019]. Retrieved from the Internet: <URL: https://www.ebay.com/p/1801587473?id=183977602105>.
(Continued)

*Primary Examiner* — Justin M Larson
(74) *Attorney, Agent, or Firm* — Cramer Patent & Design, PLLC; Aaron R. Cramer

(57) ABSTRACT

An armband holder for a personal electronic device is capable of being secured about the arm of a user by means of an adjustable band. Adjacent the elastic holder for an electronic device is an elastic holster configured to removably secure a canister of pepper spray therein.

20 Claims, 6 Drawing Sheets

(56) References Cited

U.S. PATENT DOCUMENTS

| | | | | |
|---|---|---|---|---|
| D591,499 | S * | 5/2009 | Ross, III | D3/218 |
| 7,810,683 | B2 * | 10/2010 | Chan | A45F 5/00 224/222 |
| 8,328,055 | B1 | 12/2012 | Snyder | |
| 8,662,362 | B1 | 3/2014 | Bastian et al. | |
| 8,668,122 | B2 * | 3/2014 | Case | A45F 5/00 224/218 |
| 8,714,422 | B2 * | 5/2014 | Yu | H04M 1/04 224/219 |
| 8,771,085 | B1 | 7/2014 | Clyde et al. | |
| 9,615,650 | B2 | 4/2017 | Soriano et al. | |
| 9,693,623 | B2 * | 7/2017 | Bryant | A45C 11/00 |
| 9,927,213 | B2 | 3/2018 | Komperda | |
| 10,362,855 | B2 | 7/2019 | Whang et al. | |
| D879,763 | S * | 3/2020 | Park | D14/250 |
| D891,776 | S * | 8/2020 | Eremita | D3/303 |
| 2006/0011687 | A1 * | 1/2006 | Wadley | A45F 3/00 224/587 |
| 2006/0097019 | A1 * | 5/2006 | Just-Buddy | A45F 5/021 224/148.7 |
| 2008/0087695 | A1 * | 4/2008 | Froelich | A45F 5/02 224/196 |
| 2009/0039121 | A1 * | 2/2009 | Paul | A45F 5/00 224/222 |
| 2012/0024917 | A1 * | 2/2012 | Case | A45F 5/021 224/259 |
| 2012/0091312 | A1 * | 4/2012 | Baker | F16M 13/04 248/682 |
| 2012/0097831 | A1 * | 4/2012 | Olukotun | F16M 13/022 248/688 |
| 2016/0183667 | A1 * | 6/2016 | MacColl | A45F 5/00 224/222 |
| 2021/0085064 | A1 * | 3/2021 | Khalsa | A45C 13/02 |
| 2021/0127816 | A1 * | 5/2021 | Sirichai | A45F 5/00 |

OTHER PUBLICATIONS

Pepper spray as a clip-on accessory. Product Listing [online]. © 2020 GSM History: History of GSM, Mobile Networks, Vintage Mobiles, All rights reserved. Published by stephenTemple.co.uk.. [retrieved on Oct. 10, 2019]. Retrieved from he Internet: <URL: http://www.gsmhistory.com/new-design-trends-in-mobiles/#pepper_spray_mobile>.

* cited by examiner

ARMBAND HOLDER FOR A PERSONAL ELECTRONIC DEVICE

RELATED APPLICATIONS

None.

FIELD OF THE INVENTION

The presently disclosed subject matter is directed to an armband holder and more specifically to an armband holder for a personal electronic device.

BACKGROUND OF THE INVENTION

Modern concerns over health and physical fitness have produced an abundance of people who religiously participate in a variety of exercise regimens in order to stay in shape. One of the most popular exercise activities is running or jogging. The muscular and cardiovascular workout associated with this activity makes it an effective means by which to stay fit. Many people entertain themselves while jogging by listening to music on their cell phone. Even if they do not, most people want to keep their cell phone with them at all times so that they can remain in constant communication.

As jogging or running clothing do not have pocket suitable for securing cell phones, many are forced to hold such items in their hands, which is clumsy at best and a safety issue at worst. Others may desire to carry personal protective items such as mace or pepper spray to ward off dog attacks and similar threats, but once again, a lack of a suitable storage location that can be easily accessed under a duress situation is non-existent. Accordingly, there exists a need for a means by which runners and joggers can be provided the ability to securely hold cell phones and personal protective items in a safe and secure manner while performing outdoor activities. The development of the armband carrier for a personal electronic device fulfills this need.

SUMMARY OF THE INVENTION

The principles of the present invention provide for an armband carrier comprises an arm band strap wrapping around an upper arm of a wearer. The arm band strap is provided with an attachment means to secure the armband carrier around the upper arm of the wearer. The armband carrier further comprises a personal electronics carrier adjustably attached to the arm band strap. The personal electronics carrier is provided with a lower pocket, a middle elastic strap and a pair of upper elastic corner straps to hold a personal electronic device. The armband carrier further comprises a personal protective spray carrier which is adjustably attached to the arm band strap and a backing surface which attaches to the lower pocket, the middle elastic strap, and the upper elastic straps. The large personal protective spray carrier may be provided with a large elastic strap to hold a bottle of personal protective spray.

The wearer is a person selected from the group consisting of a walker, a jogger, or a runner. The arm band strap may be water-resistant and/or ultraviolet-resistant. The arm band strap may be made of nylon. The armband carrier may further comprise a buckle to capable of adjusting an arm band strap length of the arm strap. The arm band strap may accommodate a person selected from the group consisting of a male wearer, a female wearer, or a child wearer. The personal electronic device may be a device selected from the group consisting a digital music player, a two-way radio, a sports camera, or a cellphone. The lower pocket, the middle elastic strap, and the upper elastic corner straps may be made of a stretchable material to accommodate a wide variety of personal electronic device sizes. The personal electronics carrier and the personal protective spray carrier may accommodate a left-handed wearer or a right-handed wearer.

The lower pocket, the middle elastic strap, and the upper elastic straps may be sewn onto the backing surface. The attachment means may include a hook portion of a hook and loop fastener disposed on the backing surface. The attachment means may also include a loop portion of a hook and loop fastener disposed on the arm band strap that is aligned with the hook portion of a hook and loop fastener disposed on the backing surface to couple the personal electronic device to the armband carrier. The attachment means may include a metal snap system mechanically attached to the arm band strap and the backing surface to couple the personal electronic device to the armband carrier. The bottle of personal protective spray may be held via friction fit to allow the bottle of personal protective spray to be readily grasped, removed, and ready to spray. The bottle of personal protective spray may be mace or pepper spray and may be of the size range of a 1 oz. to 4 oz. container or ½ oz. to ¾ oz. container.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
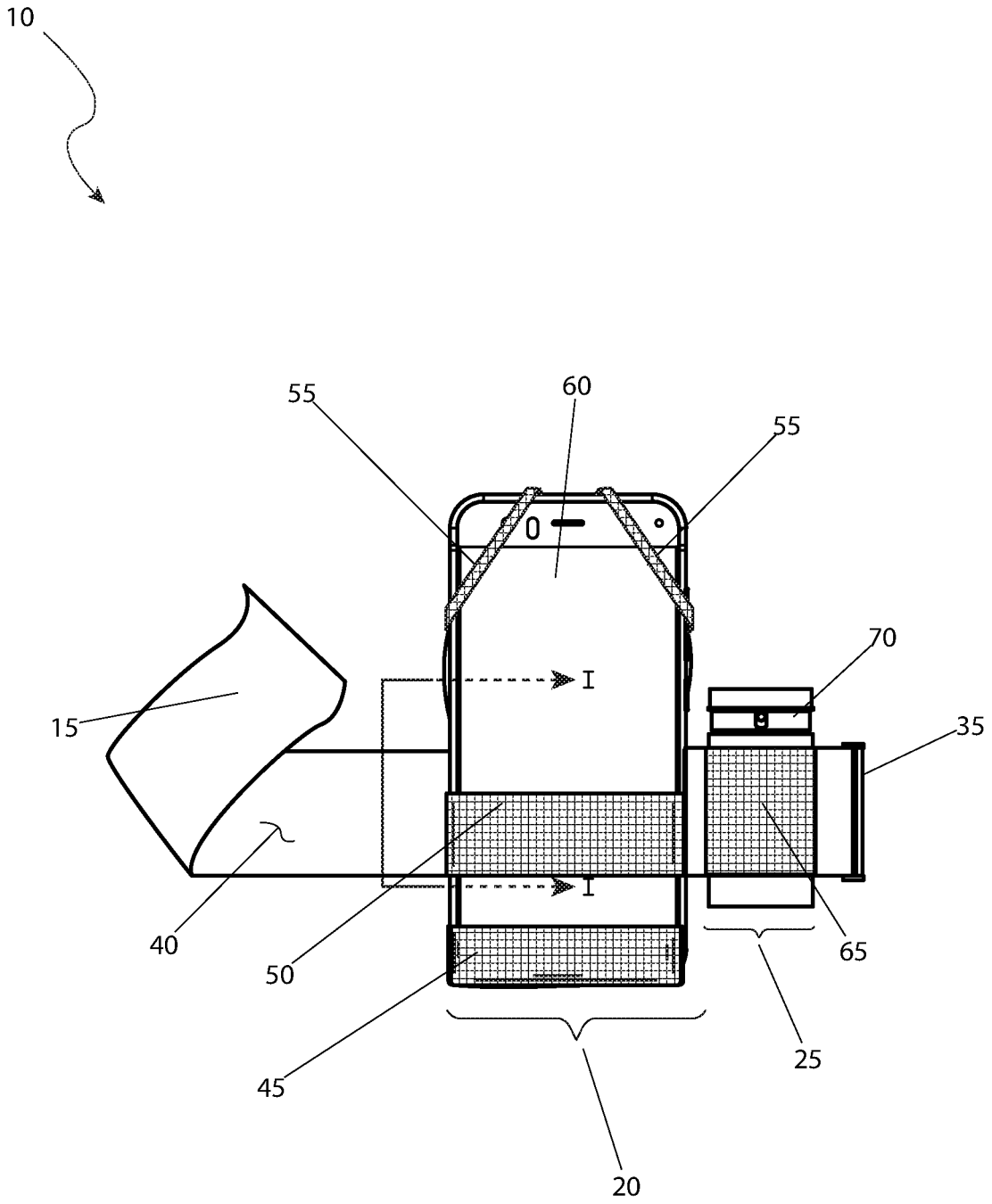
FIG. 1 is a front view of the armband carrier, shown with a large personal protective spray carrier, according to the preferred embodiment of the present invention.

10 armband carrier
15 arm band strap
20 personal electronics carrier
25 large personal protective spray carrier
30 small personal protective spray carrier
35 buckle
40 attachment means
45 lower pocket

50 middle elastic strap
55 upper elastic strap
60 personal electronic device
65 large elastic strap
70 large bottle of personal protective spray
75 small elastic strap
80 small bottle of personal protective spray
85 backing surface
90 stitching
95 loop portion
100 first fastener system
105 hook portion
110 second fastener system
115 user
120 upper arm

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the armband carrier 10, shown with a large personal protective spray carrier 25, according to the preferred embodiment of the present invention is disclosed. The armband carrier 10 (herein also described as the "carrier") 10, includes four (4) major components. First, is an arm band strap 15 that goes around the upper arm of a jogger or runner, second is a personal electronics carrier 20 adjustably attached to the arm band strap 15, third is a large personal protective spray carrier 25 also adjustably attached to the arm band strap 15, and fourth is a small personal protective spray carrier 30 (not shown in this FIGURE) that is used in lieu of the large personal protective spray carrier 25. The arm band strap 15 is envisioned to be made of water and ultraviolet-resistant nylon material and is provided with a buckle 35 which allows for infinitely variable sizing to fit all sizes of users including adult males and females, as well as children. The exterior of the arm band strap 15 is provided with an attachment means 40 such as a part of a first fastener system 100 or with a second fastener system 110. Further detail on the attachment means 40 will be provided here in below. It is envisioned that the arrangement of the personal electronics carrier 20 and the small personal protective spray carrier 30 (or buckle 35) would be variable per the user's choice as well as for right and left-handed users.

The personal electronics carrier 20 is provided with a lower pocket 45, a middle elastic strap 50 and two (2) upper elastic straps 55 to hold a personal electronic device 60, here shown as a cellular phone as illustrated. Other types of personal electronic devices 60 such as a digital music player, two-way radio, sports camera, or the like may also be utilized. The exact type of personal electronic device 60 as used with the personal electronics carrier 20 is not intended to be a limiting factor of the present invention. Such an arrangement holds the personal electronic device 60 securely even under severe motion while allowing any audible information or alerts from the personal electronic device 60 to be heard. The large personal protective spray carrier 25 is provided with a large elastic strap 65 to hold a large bottle of personal protective spray 70 via friction fit. This arrangement allows the large bottle of personal protective spray 70 to be readily grasped, removed and ready to spray within seconds. It is envisioned that the large bottle of personal protective spray 70 could be mace, pepper spray, or the like of the one-ounce (1 oz.) to four-ounce (4 oz.) size containers. The exact type and style of large bottle of personal protective spray 70 used with the carrier 10 is not intended to be a limiting factor of the present invention.

Figure 2:
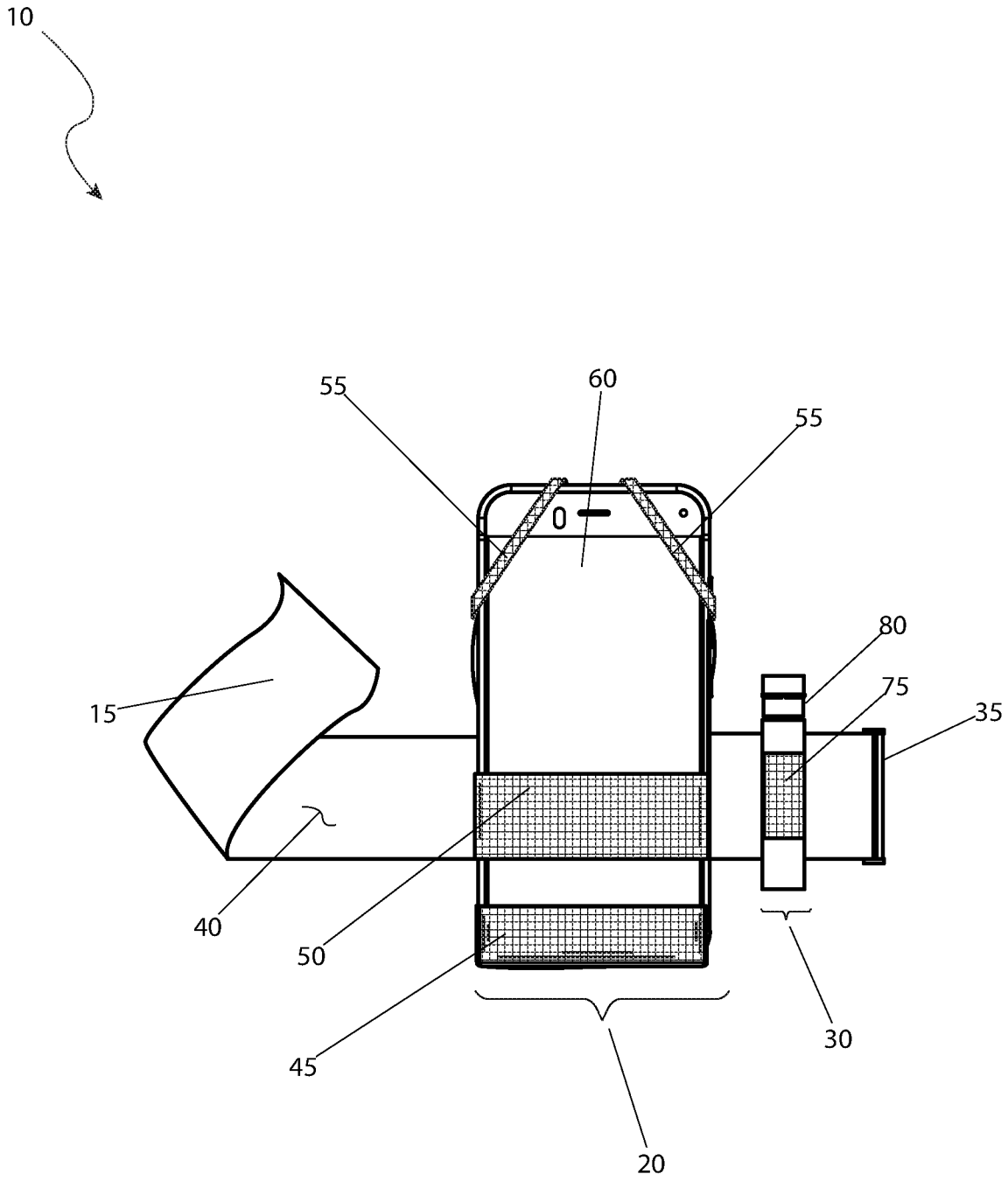
FIG. 2 is a front view of the armband carrier, shown with a small personal protective spray carrier, according to the preferred embodiment of the present invention.

Referring next to FIG. 2, a front view of the carrier 10, shown with a small personal protective spray carrier 30, according to the preferred embodiment of the present invention is depicted. The arrangement of the personal electronics carrier 20, the arm band strap 15, the buckle 35 and the attachment means 40 remain as shown in FIG. 1, however, the large personal protective spray carrier 25 (as shown in FIG. 1) has been replaced with the small personal protective spray carrier 30. Similar to the large personal protective spray carrier 25, the small personal protective spray carrier 30 is provided with a small elastic strap 75 to hold a small bottle of personal protective spray 80 via friction fit. This arrangement allows the small bottle of personal protective spray 80 to be readily grasped, removed and ready to spray within seconds. It is envisioned that the small bottle of personal protective spray 80 could be mace, pepper spray, or the like of the half ounce (½ oz.) to three-quarters ounce (¾ oz.) containers. The exact type and style of small bottle of personal protective spray 80 used with the carrier 10 is not intended to be a limiting factor of the present invention.

Figure 3:
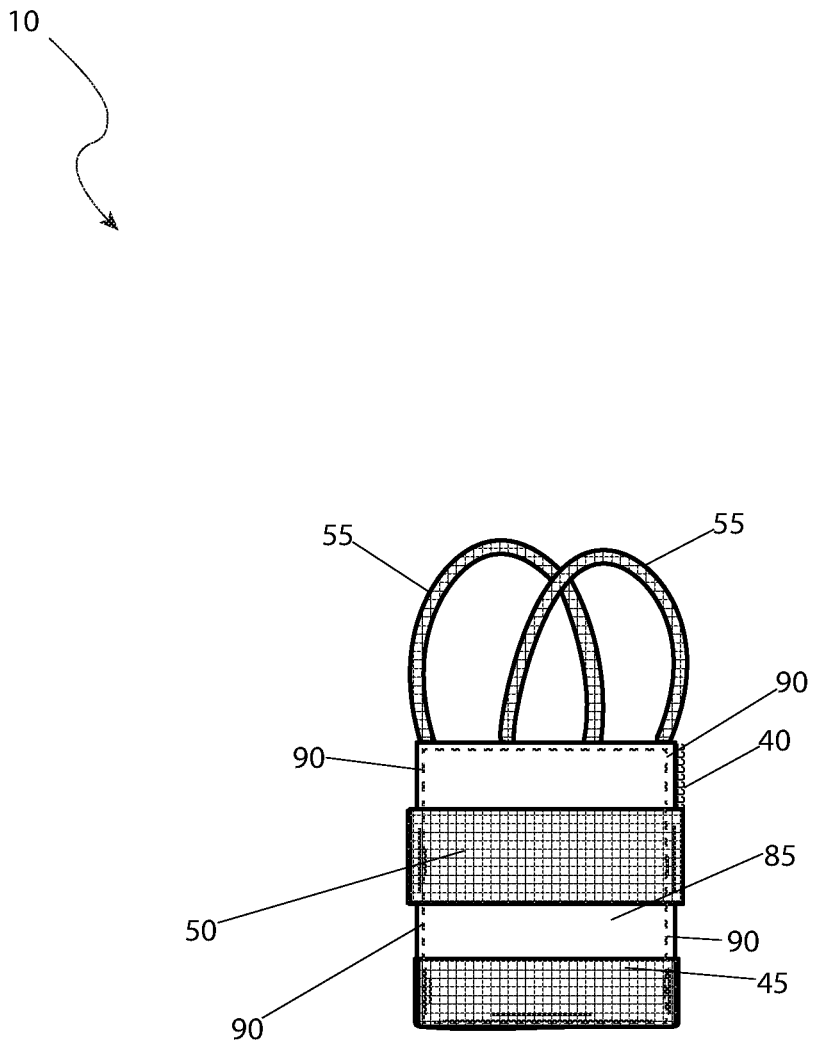
FIG. 3 is a front view of the personal electronics carrier, as used with the armband carrier, according to the preferred embodiment of the present invention.

Referring now to FIG. 3, a front view of the personal electronics carrier 20, as used with the carrier 10, according to the preferred embodiment of the present invention is shown. The personal electronic device 60 (as shown in FIG. 1) has been removed for purposes of clarity. The lower pocket 45, the middle elastic strap 50, and the upper elastic straps 55 all are of a stretchable material to accommodate a wide variety of cellular phones. It is envisioned that other personal electronics carrier 20 with differing dimensions and aspect ratios could also be manufactured to fit all makes and models of personal electronic device 60. A backing surface 85 to which the lower pocket 45, the middle elastic strap 50, and the upper elastic straps 55 are sewn via stitching 90 is visible. An attachment means 40, here shown as the hook side of a first fastener system 100 is partially visible on the rear of the backing surface 85.

Figure 4:
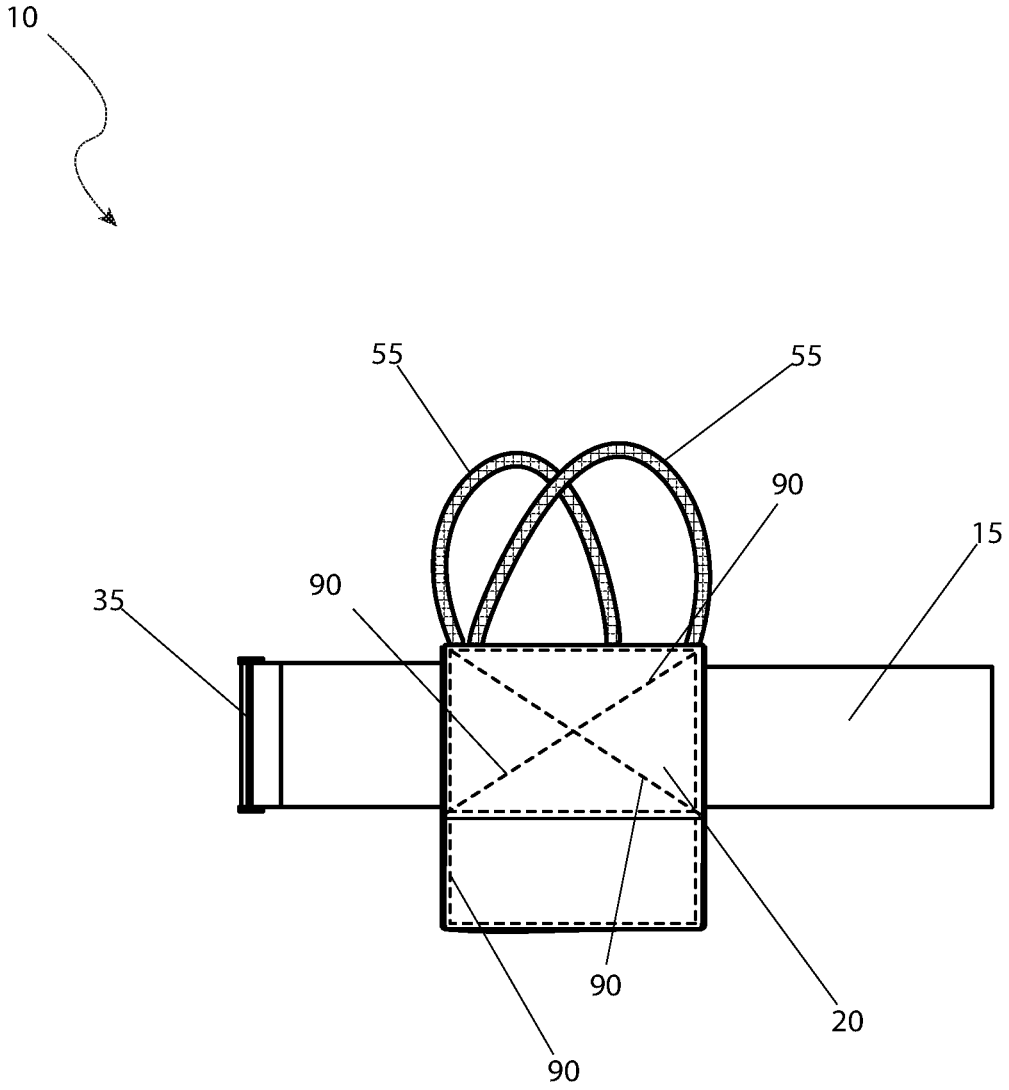
FIG. 4 is a rear view of the personal electronics carrier attached to the armband strap, as used with the armband carrier, according to the preferred embodiment of the present invention.

Referring now to FIG. 4, a rear view of the personal electronics carrier 20 and the adjustably attached to the arm band strap 15. The personal electronics carrier 20, as described in more below, can be placed about a desired position on the arm band strap 15.

Figure 5A:
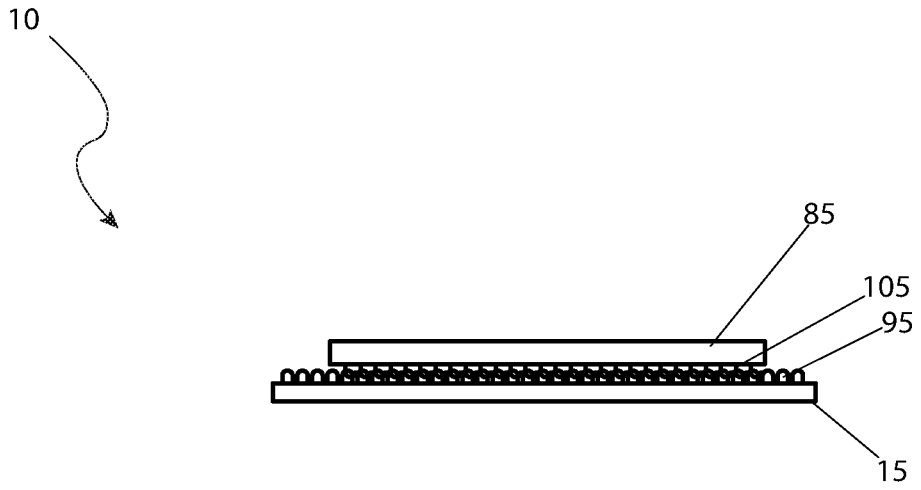
FIG. 5*a* is a sectional view of the armband carrier, as seen along a line I-I, as shown in FIG. 1, according to the preferred embodiment of the present invention.

Referring next to FIG. 5*a*, a sectional view of the carrier 10, as seen along a line I-I, as shown in FIG. 1, according to the preferred embodiment of the present invention is disclosed. The arm band strap 15 is shown at the bottom with the backing surface 85 above in a parallel arrangement. A loop portion 95 of a first fastener system 100 is physically secured to the arm band strap 15, while the hook portion 105 is physically secured to the backing surface 85. The physical securement is envisioned to be sewing, adhesives, or the like. The first fastener system 100 allows for ready removal and replacement of the backing surface 85 to allow for usage of the personal electronic device 60 (as shown in FIG. 1) or realignment to suit left or right-handed users. A similar arrangement would be used to attach either the large elastic strap 65 (as shown in FIG. 1) or the small elastic strap 75 (as shown in FIG. 2).

Figure 5B:
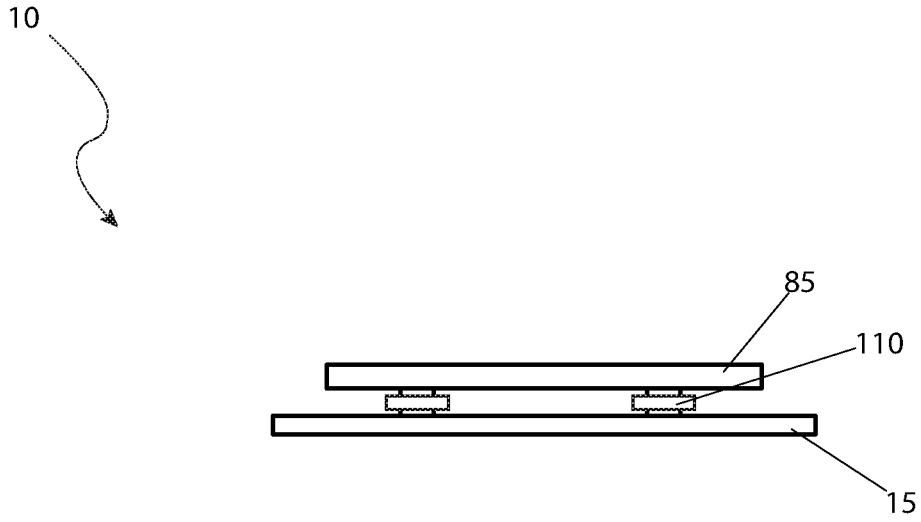
FIG. 5*b* is a sectional view of the armband carrier, as seen along a line I-I, as shown in FIG. 1, according to an alternate embodiment of the present invention; and, FIG. 6 is a perspective view of the armband carrier, shown in a utilized state, according to the preferred embodiment of the present invention.

Referring now to FIG. 5*b*, a sectional view of the carrier 10, as seen along a line I-I, as shown in FIG. 1, according to an alternate embodiment of the present invention is depicted. The arm band strap 15 is shown at the bottom with the backing surface 85 above in a parallel arrangement. A second fastener system 110, such as a metal snap system as illustrated herein. is mechanically attached to the arm band strap 15 and backing surface 85 in a conventional manner. This arrangement allows the backing surface 85 to be removed from the arm band strap 15 as desired for usage of the personal electronic device 60 (as shown in FIG. 1) or realignment to suit left or right-handed users. A similar arrangement would be used to attach either the large elastic strap 65 (as shown in FIG. 1) or the small elastic strap 75 (as shown in FIG. 2).

Figure 6:
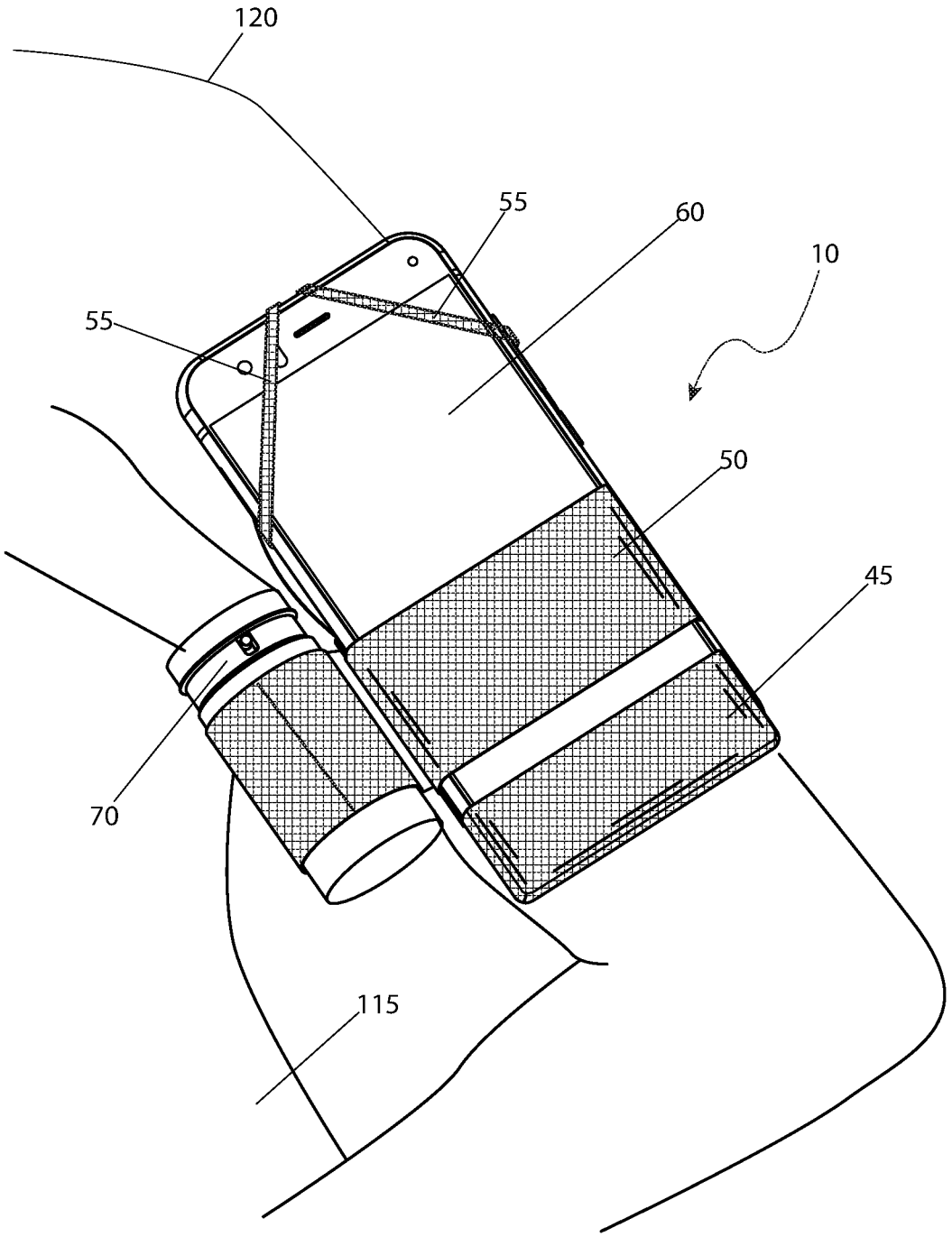

Referring to FIG. 6, a perspective view of the carrier 10, shown in a utilized state, according to the preferred embodiment of the present invention is shown. A user 115 wears the carrier 10 on either the left- or right-hand upper arm 120. It is envisioned that the large bottle of personal protective spray 70 (as shown) or the small bottle of personal protective spray 80 (not shown) would be placed in the forward position on the arm band strap 15 for ease of access. The large elastic strap 65 is attached by a second fastener system 110 in this view for purposes of illustration. The personal electronic device 60 is placed within the personal electronics carrier 20 and secured by the lower pocket 45, the middle elastic strap 50, and the upper elastic straps 55 where it remains easy to access, easy to hear, and does not require holding in the hands of the user 115.

2. Operation of the Preferred Embodiment

The preferred embodiment of the present invention can be utilized by the common user in a simple and effortless manner with little or no training. It is envisioned that the carrier 10 would be constructed in general accordance with FIG. 1 through FIG. 6. The user would procure the carrier 10 from conventional procurement channels such as department stores, discount stores, electronics retailers, mail order and internet supply houses and the like. Special attention would be paid to overall color and style along with size of the personal electronics carrier 20.

After procurement and prior to utilization, the carrier 10 would be prepared in the following manner: the personal electronic device 60 would be placed in the personal electronics carrier 20 and secured within the lower pocket 45, the middle elastic strap 50 and the upper elastic straps 55; the large bottle of personal protective spray 70 would be placed within the large elastic strap 65 or the small bottle of personal protective spray 80 would be placed within the small elastic strap 75; the personal electronics carrier 20 and the large personal protective spray carrier 25 or the small personal protective spray carrier 30 would be secured onto the arm band strap 15 with the use of the attachment means 40 consisting of either the first fastener system 100 or the second fastener system 110; and the arm band strap 15 would be secured to the upper arm 120 (either right or left side as preferred) via the buckle 35, either on bare skin or over clothing.

During utilization of the carrier 10, the following procedure would be initiated: running, jogging, walking, commuting, pet walking, or similar activity would take place in a conventional manner. Should an event requiring use of either the large bottle of personal protective spray 70 or the small bottle of personal protective spray 80 occur, the user 115 would use the hand of the arm not provided with the carrier 10, to reach over and simply lift the large bottle of personal protective spray 70 or small bottle of personal protective spray 80 free whereupon it is ready to use (dispense) in a manner of a few seconds. Should the personal electronic device 60 require access, the upper elastic straps 55 may be moved free and the personal electronic device 60 lifted free of the lower pocket 45 and middle elastic strap 50 in a similar manner.

After use of the carrier 10, it is simply removed and set aside until needed again. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An armband carrier, comprising:

arm band strap adapted to wrap around an upper arm of a wearer, the arm band strap is provided with a first attachment means secure the armband carrier around the upper arm of the wearer;

a personal electronics carrier adjustably attached to the arm band strap via a second attachment means, the personal electronics carrier provided with a lower pocket, a middle elastic strap and a pair of upper elastic corner straps to hold a personal electronic device;

a personal protective spray carrier adjustably attached to the arm band strap; and a backing surface attaching the lower pocket, the middle elastic strap, and the pair of upper elastic corner straps;

wherein the personal protective strap carrier is provided with an elastic strap to hold a bottle of personal protective spray.

2. The armband carrier according to claim 1, wherein the wearer is a person selected from the group consisting of a walker, a jogger, or a runner.

3. The armband carrier according to claim 1, wherein the arm band strap is water-resistant.

4. The armband carrier according to claim 1, wherein the arm band strap is ultraviolet-resistant.

5. The armband carrier according to claim 1, wherein the arm band strap is made of nylon.

6. The armband carrier according to claim 1, wherein the first attachment means comprises a buckle to adjust a length of the arm band strap.

7. The armband carrier according to claim 6, wherein the arm band strap accommodates a person selected from the group consisting of a male wearer, a female wearer, or a child wearer.

8. The armband carrier according to claim 1, wherein the personal electronic device is a device selected from the group consisting a digital music player, a two-way radio, a sports camera, or a cellphone.

9. The armband carrier according to claim 1, wherein the lower pocket, the middle elastic strap, and the upper elastic corner straps are made of a stretchable material to accommodate a wide variety of personal electronic device sizes.

10. The armband carrier according to claim 1, wherein the personal electronics carrier and the personal protective spray carrier accommodate a left-handed wearer.

11. The armband carrier according to claim 1, wherein the personal electronics carrier and the personal protective spray carrier accommodate a right-handed wearer.

12. The armband carrier according to claim 1, wherein the lower pocket, the middle elastic strap, and the upper elastic corner straps are sewn onto the backing surface.

13. The armband carrier according to claim 1, wherein the second attachment means includes a hook portion of a hook and loop fastener disposed on the backing surface.

14. The armband carrier according to claim 13, wherein the second attachment means includes a loop portion of a hook and loop fastener disposed on the arm band strap that is aligned with the hook portion of a hook and loop fastener disposed on the backing surface to couple the personal electronic device to the armband carrier.

15. The armband carrier according to claim 1, wherein the second attachment means means includes a metal snap system mechanically attached to the arm band strap and the backing surface to couple the personal electronic device to the armband carrier.

16. The armband carrier according to claim 1, wherein the bottle of personal protective spray is held via friction fit to allow the bottle of personal protective spray to be readily grasped, removed, and ready to spray.

17. The armband carrier according to claim 1, wherein the bottle of personal protective spray is mace.

18. The armband carrier according to claim 1, wherein the bottle of personal protective spray is pepper spray.

19. The armband carrier according to claim 1, wherein the bottle of personal protective spray is in the range of a 1 oz. to 4 oz. container.

20. The armband carrier according to claim 1, wherein the bottle of personal protective spray is in the range of a ½ oz. to ¾ oz. container.

* * * * *